US005712531A

United States Patent [19]

Rademacher et al.

[11] Patent Number: 5,712,531

[45] Date of Patent: Jan. 27, 1998

[54] HIGH-PRESSURE DISCHARGE LAMP WITH A SINTERED COMPACT CONTAINING LANTHANUM OXIDE

[75] Inventors: Albert Rademacher, Köln; Ulrich Rösner, Wipperfürth, both of Germany

[73] Assignee: Patent - Truehand - Gesellshaft fuer electrishe Gluelampen mbH, Munich, Germany

[21] Appl. No.: 688,595

[22] Filed: Jul. 30, 1996

[30] Foreign Application Priority Data

Aug. 17, 1995 [DE] Germany ..... 195 30 293.1

[51] Int. Cl.[6] ..... H01J 17/04; H01J 61/73

[52] U.S. Cl. ..... 313/631; 313/346 R; 313/633; 313/311; 252/521

[58] Field of Search ..... 313/630, 631, 313/346 R, 311, 352, 491, 575; 252/521

[56] References Cited

FOREIGN PATENT DOCUMENTS 0647964 10/1994 European Pat. Off. .

55-15545 12/1988 Japan .

OTHER PUBLICATIONS

High temperature metal halide chemistry, proceedings of the symposium on D.L. Hildenbrand & D.D. Cubiciotti pp. 85 –95.

*Primary Examiner*—Ashok Patel
*Assistant Examiner*—Jay M. Patidar
*Attorney, Agent, or Firm*—William H. McNeil

[57] ABSTRACT

The invention concerns high-pressure discharge lamps, whose electrodes have a sintered compact (5) containing lanthanum oxide acting as an electron emitter, and this compact is surrounded by an electrode coil (6). Sintered compact (5) contains at least 90 weight % lanthanum oxide. In this way, a high thermal stability of sintered compact (5) and a good ignition performance of the lamp are assured with only negligible blackening of the discharge vessel over the service life of the lamp.

7 Claims, 1 Drawing Sheet

HIGH-PRESSURE DISCHARGE LAMP WITH A SINTERED COMPACT CONTAINING LANTHANUM OXIDE

TECHNICAL FIELD

The invention relates to high-pressure discharge lamps and more particularly to such high-pressure discharge lamps having a light-transparent, gas-tight, sealed discharge vessel, an ionizable filler enclosed therein, and electrodes extending into the discharge space and sealed in the discharge vessel. These electrodes are joined with current leads whereby the electrodes have a sintered compact containing lanthanum oxide and an electrode coil which surrounds the sintered compact.

BACKGROUND ART

Such high-pressure discharge lamps are disclosed, for example, in Japanese Patent Application JP 55(1980)155, 457. This patent application describes a high-pressure discharge lamp with electrodes, which have a metal rod projecting into the discharge space and a cylindrical sintered compact containing lanthanium oxide as well as an electrode coil. The sintered compact is arranged at the free end of the metal rod and is surrounded by the electrode coil. The electrode coil also encloses the end of the metal electrode rod that is mined toward the sintered compact. The sintered compact is shaped like an electron emitter. It does not contain radioactive thorium oxide, but is comprised of lanthanum oxide, yttrium oxide and tungsten, whereby lanthanum oxide and yttrium oxide together have a weight proportion of 0.2–60% of the sintered compact. The ratio of lanthanum oxide to yttrium oxide amounts to 0.5–50 molar %. It is a disadvantage that this electron emitter does not possess sufficient thermal stability over the service life of the lamp.

A high-pressure discharge lamp with a nonradioactive electron emitter is also disclosed in the Offenlegungsschrift [Unexamined] EP 0 647,964. This electron emitter comprises a first metal oxide with a relatively high electron work function, which is selected from the group of hafnium oxide and zirconium oxide, and of a second metal oxide with a relatively low electron work function, which is selected from the group of yttrium oxide, lanthanum oxide, cerium oxide, and scandium oxide. This electron emitter possesses a relatively large number of components, it is not sufficiently thermally stable over the service life of the lamp, and is not neutral in color in discharge.

DISCLOSURE OF THE INVENTION

It is, therefore, an object of the invention to produce a high-pressure discharge lamp with an improved electron emitter, which possesses, in particular, a thermal stability that is sufficient over the service life of the lamp and assures a good ignition performance of the lamp with as small as possible a blackening of the discharge container.

It is another object of the invention to obviate the disadvantages of the prior art.

Yet another object of the invention is the enhancement of high pressure discharge lamps.

These objects are resolved, according to one aspect of the invention, by provision of a high-pressure discharge lamp with a light-transparent, gas-tight, sealed discharge vessel having therein an ionizable filler. Electrodes extend into the discharge space and are sealed in the discharge vessel. These electrodes are joined with current leads whereby the electrodes have a sintered compact containing lanthanum oxide and an electrode coil which surrounds the sintered compact. The sintered compact contains at least 90 weight % lanthanum oxide.

The high-pressure discharge lamp according to the invention possesses electrodes, which are equipped with a sintered compact acting as the electron emitter. The sintered compact is surrounded by an electrode coil and contains at least 90 weight % of lanthanum oxide according to the invention. In this way, the sintered compact receives a high thermal stability over the entire service life of the lamp and there is no noteworthy blackening of the discharge vessel. Also, the lamp has a good ignition performance with this electron emitter. According to a particularly preferred first example of embodiment, the sintered compact is comprised exclusively of lanthanum oxide. This sintered compact has a very high thermal stability and causes practically no blackening of the discharge vessel over the entire service life of the lamp. It has been shown that the addition of other substances with a small electron work function, such as, for example, yttrium oxide, is not unconditionally necessary in order to obtain a satisfactory ignition performance of the lamp. According to a second particularly preferred example of embodiment, the sintered compact contains another electron emitter, in addition to lanthanum oxide, and this consists of the two components barium oxide and tungsten oxide, which result from a eutectic mixture of barium carbonate and tungsten oxide. The ignition performance of the high-pressure discharge lamp is improved still further by the small addition of this other electron emitter to the lanthanum oxide, and the blackening behavior is only slightly adversely affected when compared with the first example of embodiment. In addition, it has proven advantageous to use a two-ply wound electron coil, which surrounds the sintered compact. In this way, the sintered compact emitting electrons is heated to a relatively higher temperature during the ignition phase and thus the thermal electron emission is improved. The end of the electrode* coil on the discharge side advantageously projects over the sintered compact and has a constricted inner diameter, which is smaller than the diameter of the sintered compact, whereas the other end of the electrode coil encloses the end of the electrode rod bounding the sintered compact. On the one hand, the attachment of the sintered compact to the electrode rod is improved by this measure, and on the other hand, the blackening of the discharge vessel is reduced further by emitter material that is sputtered.

BEST MODE FOR CARRYING OUT THE INVENTION

Figure 1:
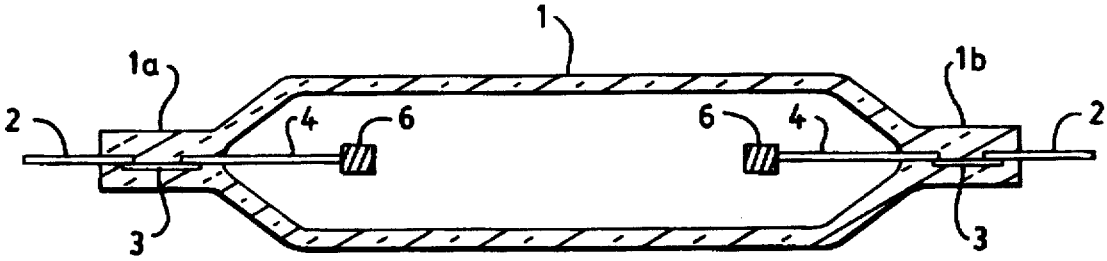
FIG. 1 shows a cross section through the discharge vessel of a high-pressure discharge lamp.
Figure 2:
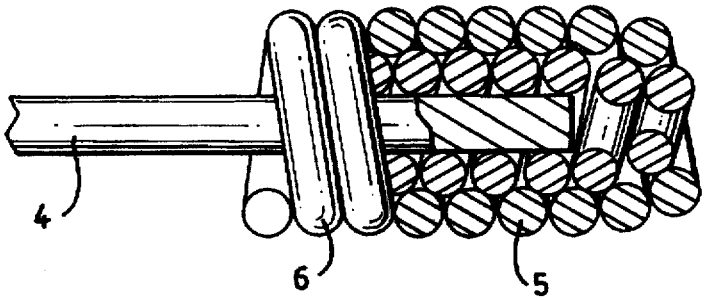
FIG. 2 shows a schematic representation of the structure of a lamp electrode, partially cut away.

FIG. 1 shows the structure of the discharge vessel of the high-pressure discharge lamp according to the two examples of embodiment that will be described more closely. Discharge vessel 1 is essentially cylindrical and it can comprises quartz glass. It has two gas-tight sealed ends 1*a*, 1*b*, into which an electrode system is sealed in the known way. The electrodes each have a current lead 2, which is joined by means of a molybdenum foil seal 3 with an electrode rod 4 comprised of a high-melting metal, such as molybdenum or tungsten, for example. Electrode rods 4 end in the discharge space and are aligned axially in discharge vessel 1. A sintered compact 5 wound by an electrode coil 6 is attached at the end of electrode rod 4 on the discharge side. Particulars of the lamp electrodes are illustrated schematically in FIG. 2. Electrode coil 6 is designed as two-ply. The diameter of electrode rod 4 is approximately 1.0 mm for a halogen metal vapor high-pressure discharge lamp with an electrical power consumption of approximately 2000 W, corresponding to the two examples of embodiment described here. The diameter of sintered compact 5 is only slightly smaller. Electrode coil 6 is pushed onto the end of electrode rod 4 on the discharge side. It closely envelops sintered compact 5 and the end of electrode rod 4 on the discharge side and also projects out over the end of sintered compact 5 on the discharge side. The inner diameter of electrode coil 6 is constricted to approximately 0.7 mm on the end on the discharge side, and is thus smaller than the diameter of electrode rod 4 and sintered compact 5. The diameter of the coil wire amounts to approximately 0.8 min. In the first example of embodiment, sintered compact 5 exclusively comprises lanthanum oxide. It has a mass of approximately 10 mg.

The second example of embodiment differs from the first example of embodiment only by the composition of sintered compact 5. According to the second example of embodiment, sintered compact 5 comprises 95.1 weight % lanthanum oxide and 4.9 weight % of another electron emitter, which in turn comprises barium oxide and tungsten oxide. The total weight of the sintered compact is approximately 10 mg. For the production of sintered compact 5, a eutectic mixture of barium carbonate and tungsten oxide, i.e. 22.04 weight % barium carbonate with 77.96 weight % tungsten oxide is prepared, which is then mixed with the lanthanum oxide with the addition of nitrocellulose binder. The weight component of lanthanum oxide in the mixture amounts to approximately 94.8 weight % without considering the nitrocellulose binder, and the proportion of eutectic mixture then amounts to approximately 5.2 weight percent. This mixture is pressed into rods, cut, and sintered in a hydrogen atmosphere. The binder is thoroughly heated during the sintering process and the barium carbonate is converted to barium oxide.

The invention is not limited to the above examples of embodiment that are described in detail. Sintered compacts according to the invention may also be used for other types of high-pressure discharge lamps. Only the dimensions and the mass of the sintered compact must be appropriately adapted.

What is claimed is:

1. High-pressure discharge lamp with a light-transparent, gas-tight, sealed discharge vessel (1), an ionizable filler enclosed therein, and electrodes (4) extending into the discharge space and sealed in discharge vessel (1), and these electrodes are joined with current leads (2), whereby electrodes (4) have a sintered compact (5) containing lanthanum oxide and an electrode coil (6), which surrounds sintered compact (5), is hereby characterized in that sintered compact (5) contains at least 90 weight % lanthanum oxide.

2. High-pressure discharge lamp according to claim 1, further characterized in that sintered compact (5) comprises lanthanum oxide.

3. High-pressure discharge lamp according to claim 1, further characterized in that sintered compact (5) contains barium oxide and tungsten oxide.

4. High-pressure discharge lamp according to claim 1, further characterized in that sintered compact (5) comprises lanthanum oxide, barium oxide, and tungsten oxide.

5. High-pressure discharge lamp according to claim 1, further characterized in that electrode coil (6) is designed as two ply.

6. High-pressure discharge lamp according to claim 1, further characterized in that the end of electrode coil (6) on the discharge side projects over sintered compact (5) and has a constricted inner diameter, whereby the inner diameter in the constricted end of the coil is smaller than the thickness or the diameter of sintered compact (5).

7. High-pressure discharge lamp according to claim 1, further characterized in that electrode coil (6) is pushed onto one end of the respective electrode rod (4).

* * * * *